United States Patent [19]

Mackey

[11] Patent Number: 5,020,395

[45] Date of Patent: Jun. 4, 1991

[54] PRESSURIZED CORK-REMOVAL APPARATUS FOR WINE BOTTLES AND OTHER CONTAINERS

[76] Inventor: Edward R. Mackey, 28 Nottingham Rd., Dracut, Mass. 01826

[21] Appl. No.: 509,315

[22] Filed: Apr. 13, 1990

Related U.S. Application Data

[63] Continuation of Ser. No. 278,980, Dec. 1, 1988, abandoned, which is a continuation-in-part of Ser. No. 222,163, Jul. 21, 1988, which is a continuation of Ser. No. 2,871, Jan. 13, 1987, abandoned.

[51] Int. Cl.[5] ..... B67B 7/08

[52] U.S. Cl. ..... 81/3.2; 81/3.29; 222/5; 141/19

[58] Field of Search ..... 81/3.2, 3.29, 3.36, 81/3.48, 3.49; 222/5; 220/3, 304; 206/19; 141/19, 329

[56] References Cited

U.S. PATENT DOCUMENTS

| | | | |
|---|---|---|---|
| 986,855 | 3/1911 | Peck | 81/3.29 |
| 1,421,169 | 6/1922 | Chmura | 81/3.29 |
| 2,860,634 | 11/1958 | Duncan et al. | 222/5 |
| 3,524,569 | 8/1970 | Waters | 222/5 |
| 4,260,075 | 4/1981 | Mackal | 222/5 |
| 4,317,390 | 3/1982 | Nakayama | 81/3.2 |

*Primary Examiner*—James G. Smith
*Attorney, Agent, or Firm*—Pearson & Pearson

[57] ABSTRACT

Stopper removal apparatus of the type in which gas under pressure is directed into a container thereby to eject a cork or like stopper. The apparatus directs gas from a gas cylinder into a gas reservoir sealed by a piston valve. Each gas cylinder has its own seal to prevent gas escaping during storage. As a new cylinder is installed and the cylinder seal is broken, the resulting gas from the cylinder forces the piston valve to its sealing position, so no gas escapes. The gas pressure provides the sealing force. When an actuator moves the piston valve to an open position, gas passes through passages and a hollow needle that penetrates the stopper to exit within the container to eject the stopper.

A cover assembly completely encloses the needle. A disk at one end of the cover retracts as the needle is inserted into the stopper. After the stopper is ejected it remains on the needle within the cover. Tabs extending through the cover enable the disk to be returned to its original position thereby removing the stopper and enclosing the needle.

9 Claims, 6 Drawing Sheets

PRESSURIZED CORK-REMOVAL APPARATUS FOR WINE BOTTLES AND OTHER CONTAINERS

CROSS REFERENCE TO RELATED APPLICATION

This is a continuation of my application Ser. No. 07/278,980, now abandoned filed Dec. 1, 1988, which was a continuation-in-part of patent application Ser. No. 07/222,163, filed July 21, 1988, which was a continuation of my original application Ser. No. 07/002,871, now abandoned filed Jan. 13, 1987.

FIELD OF THE INVENTION

The present invention relates to container stopper removing devices, being more particularly, though not exclusively, concerned with the gas-pressurized release of wine bottle corks and the like, the term "cork" being used herein in a generic sense to embrace stopper or other capping devices for liquid-carrying and other containers and the like.

BACKGROUND OF THE INVENTION

Prior apparatus for effecting gas-pre-sure release of, for example, wine bottle corks and the like range from disposable one-time-use pressurized gas bombs, cartridges or cylinders that apply gas under pressure through a cork-penetrating needle into the air space in the neck of the bottle above the wine level to force the cork out of the neck, to multi-use apparatus employing valves for effectively opening and closing the pierced gas cylinder outlet region or for repetitively piercing and sealing the gas cylinder cap, as described, for example, in U.S. Pat. Nos. 4,317,390 and 4,464,956.

The use of repetitive piercing and sealing of the gas cylinder or its immediate outlet region, however, is attendant with gas-leakage problems and a significant variation in the performance efficacy during successive uses of the device, particularly as the volume of remaining gas in the cylinder or cartridge diminishes. Relatively complicated, costly and adjustment-necessary valve structures have, moreover, been required, as well.

SUMMARY OF THE INVENTION

An object of the present invention, on the other hand, is to provide a new and improved cork-removal apparatus of this character that obviates such disadvantages and difficulties and that, to the contrary, enables a fixed and controlled single penetration of a gas cylinder, that is adapted for multi and repetitive use, with a simply refillable and inexpensive combined valve system and gas reservoir chamber or compartment that is remarkably gas tight and provides markedly improved uniformity of operation for successive or repetitive uses. A further object is to provide an improved gas-pressurized cork remover of more general utility, as well.

Other and further objects will occur and be explained hereinafter and are more particularly delineated in the appended claims.

In accordance with one aspect of this invention, a cork removing apparatus transfers gas from a gas cylinder with a thin seal at the opening thereof through a hollow needle means that pierces a cork to pressurize a container and eject the cork. Gas passages in the housing conduct the gas from the gas cylinder to the hollow needle means. A pressure actuated valve assembly means interposed in the gas passage means pierces the seal on the gas cylinder to admit the gas to an input port means to a gas reservoir. A valve means, including a pressure actuated piston means mounted on a valve stem means, carries a sealing means. When the apparatus is in its normal state, gas pressure from the cylinder and in the reservoir forces the piston means and its sealing means into engagement with the sealing seat. An actuator on the apparatus, when used, overcomes the force exerted by the gas on the piston means and displaces the valve stem means to separate the sealing means and the sealing seat thereby to permit the gas to flow through the hollow needle means thereby to eject the cork. When the cork is removed, the actuator is released, and the gas pressure form the cylinder and reservoir force the piston means back to its sealing position. Preferred details of construction and best mode embodiment are later presented.

DESCRIPTION OF DRAWINGS

The invention will now be described with reference to the accompanying drawings, FIG. 1 of which is a longitudinal section of embodiment of the invention, in a normal inoperative state.

DETAILED DESCRIPTION OF THE PREFERRED EMBODIMENT

Figure 1:
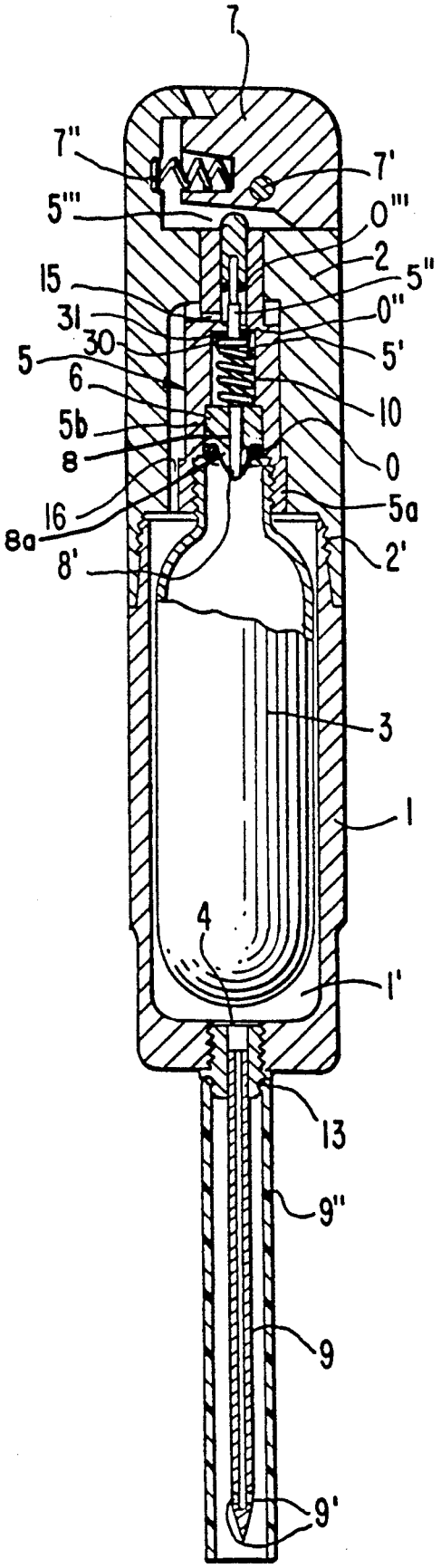

Referring to FIG. 1, the stopper cork remover apparatus is shown comprising a cylindrical housing, as of plastic or metal or the like, having a lower internally recessed housing portion 1 containing within its recess 1' a pressurized gas cylinder 3 (such as $CO_2$ or the like), and an upper housing portion 2 detachably threaded at 2' to the lower portion 1 and internally containing a valving system including a valve body 5 actuated by a pivotal actuating button 7. The bottom wall of the lower housing portion recess 1' is apertured at 4 to permit pressured gas that may be released from the cylinder 3 under action of the valving system, as later explained, to exit from near terminal openings 9' in a depending hollow needle 9 adapted to penetrate the stopper or cork 11 in, for example, a wine bottle or other container W, FIG. 2, into the space S above the contents level L, to force the cork 11 upward and out of the bottle.

Figure 2:
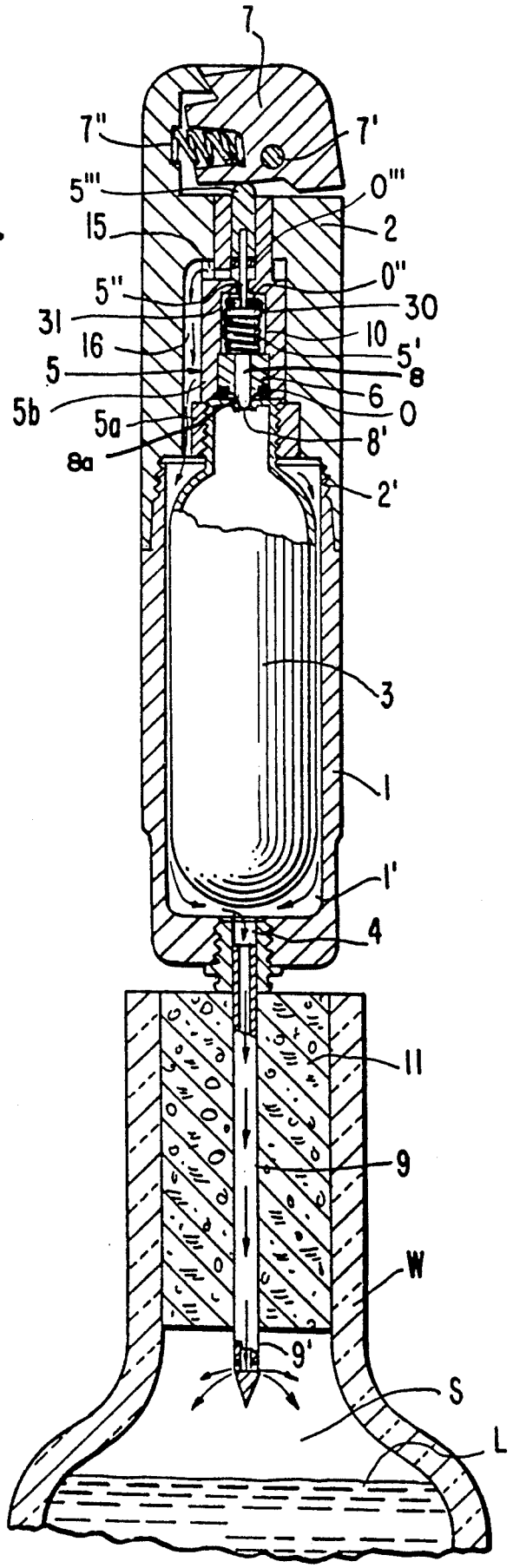
FIG. 2 is a similar view of the apparatus in use, shown applied for the removal of a wine bottle cork.
Figure 5:
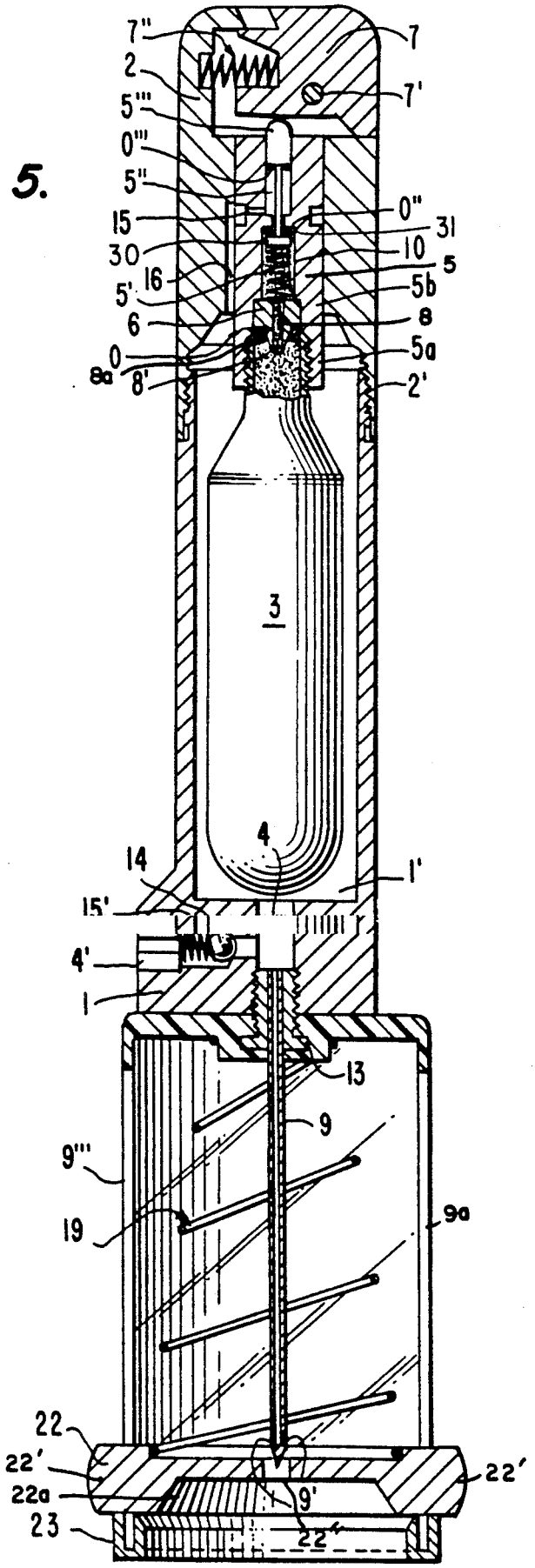
FIGS. 5 and 6 are views similar to FIGS. 1 and 2, respectively, of a modification embodying a permanently attached needle cover and apparatus for stripping a cork from the needle.
Figure 6:
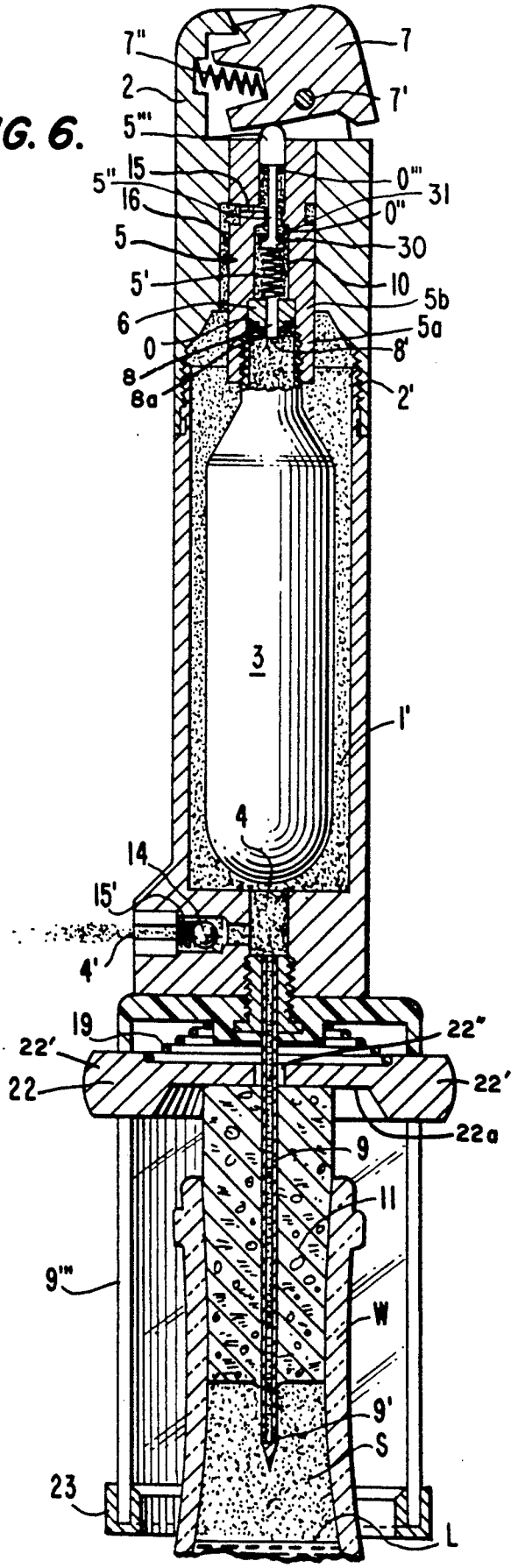

Turning to the details of the valving system, the valve body 5 contains a lower housing **5*a* (which may be an insert as shown in FIGS. 1 and 2 or an integral valve body part as shown in FIGS. 5 and 6) and a cylinder stop 6 with an axially extending passage terminating at a gas cylinder-piercing section 8 that fixedly punctures the gas cylinder top at 8', when the lower housing 5*a* is threaded upon the upper neck of the gas cylinder 3, as shown. A valve body 5*b* defines a chamber or compartment 10, and a valve stem spring 5' bears upon the top of the cylinder stop 6 and extends upwardly within the chamber of compartment 10, that serves both to contain a spring 5' and act as a gas reservoir external to the cylinder 3 with the piercing section 8 acting as an input port to the reservoir 10. More specifically, the passage through the section 8 conveys gas under pressure from the gas cylinder 3 to the gas reservoir 10**.

A piston-driven valve comprises a valve stem 5'' that terminates in an extension or piston 30. This valve reciprocates along an axis in the valve body 5. An O-ring O'' on the piston 30 provides a seal between the reservoir 10 and the remaining passages of the removal apparatus by sealing against a seat 31 defined by an internal shoulder in the valve body 5. The valve stem 5'' protrudes to a point just below the top-actuating button 7 and defines a valve actuator cam follower 5'''. An O-ring O''' serves as a seal between the passages downstream from the piston 30 and the atmosphere to prevent leakage around the valve stem 5'' and the actuator cam follower 5'''.

A lower O-ring O along the underside of the cylinder stop 6 housing the piercing section or tube 8 serves as a peripheral gas cylinder seal after the piercing of the gas cylinder. Once the gas cylinder cap is pierced, the gas enters the piercing tube 8 and travels into the reservoir chamber 10 around the valve stem spring 5' contained therein, being sealed therein in the position of FIG. 1 by the piston 30 and the valve stem seal O''. When the top actuator 7 opens the pressure actuated valve, a flow communication is established with recess 1' through upper side holes 15 and communicating lateral slot passageways 16 (FIG. 2); but in the quiescent state (FIG. 1), the gas is sealed in the chamber 10 and cannot communicate with the passageway 16.

Figure 3:
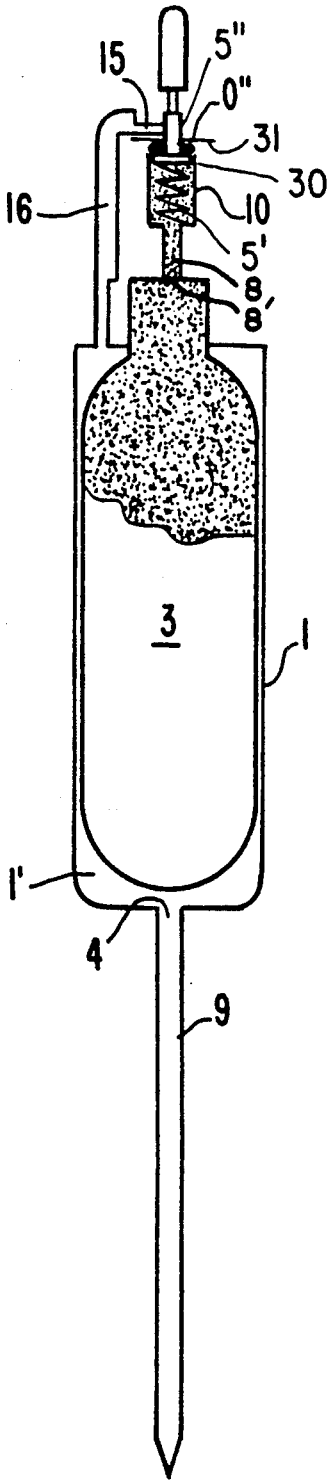
FIGS. 3 and 4 are fragmentary schematic views similar to FIGS. 1 and 2, respectively, diagrammatically illustrating pressurized gas storage and use.

In operation, once the protective needle cover 9'' is threaded off the insert needle holder and cover lock 13, FIG. 1, and pierces the bottle cork 11 or the like, FIG. 2, gas from the cylinder 3 passes, as before explained, from the reservoir chamber 10 containing the valve stem spring 5', being contained or trapped in this reservoir volume external to the gas cylinder as pressure is exerted on the piston 30 of the valve stem 5'' and in turn on the cylinder seal O-ring O'' located under the valve piston 30. Thus, in accordance with the invention, the initial release and sealing technique above-described employs the gas pressure acting on the piston 30 to effect the seal—i.e., the higher the pressure from the cylinder 3, the better the seal. The stored condition is shown in FIG. 3, with the shading representing the pressurized gas. The spring 5' merely biases the valve 5 shut when no gas pressure is applied, as when the gas cylinder 3 is empty or removed. Thus, gas pressure produces a dominant sealing force acting on the piston 30 while the spring 5' provides only a minor sealing force component.

Figure 4:
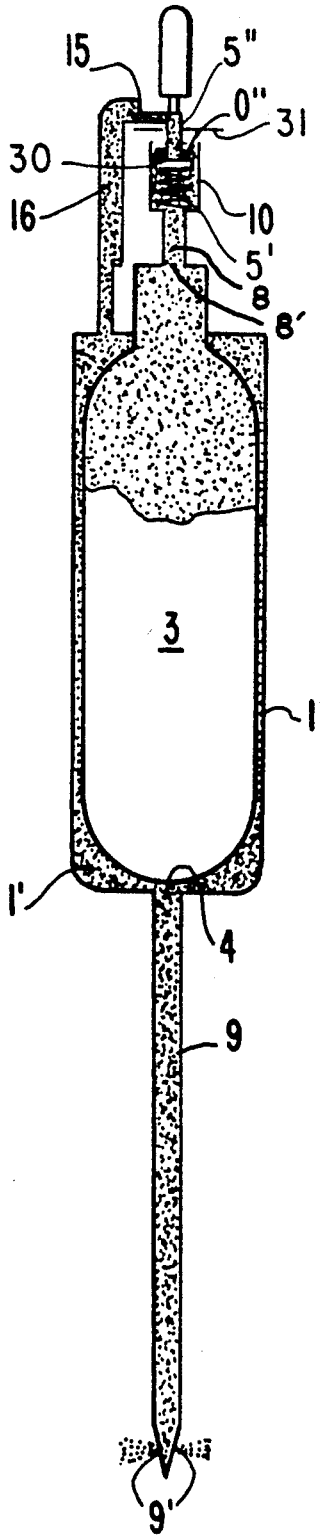

Upon depression of the actuation button 7 about its pivot or dowel 7' and in opposition to the lateral return spring 7'', the valve stem actuator cam follower 5''' to one side of, but just under, said pivot 7' and the valve stem 5'' are depressed, FIG. 2, overcoming the force produced by the gas in the reservoir chamber 10 and its back-up from the cylinder 3 acting on the piston 30. This opens the seal at the O-ring O'' and the gas travels around the valve stem 5'' through the before-mentioned side holes 15 in the valve body down the lateral slot passageways 16 in the upper housing portion 2 external to the valve body and into the recess 1' of the lower housing portion surrounding the gas cylinder 3 and down through the needle 9, exiting at its side holes 9', as before explained. This condition is illustrated by the shaded gas paths of FIG. 4.

When the actuator 7 is released, the spring 7'' biases the actuator 7 to its normal position. The gas pressure provides a dominant force for moving the piston 30 to its sealing position. This forces the O-ring O'' against the valve seal 31 thereby sealing the reservoir 10. As apparent, the pressure in the side holes 15, passageways 16, recess 1'' and the needle 9 return to atmospheric pressure.

As previously stated, and unlike some of said prior patent proposals, the invention thus always keeps the piercing pin or tube 8 in a fixed position and at fixed depth in the pierced gas cylinder or cartridge 3 and does not re-enter into it or try to valve the cylinder outlet in each use, with attendant leakage and other problems. The reservoir of gas is sealed by pressure of the gas in the reservoir 10 and the cylinder 3 acting on the piston 30 in the valve spring compartment or chamber 10 above the gas cylinder 3 until the actuation button is depressed, whence the gas stored in the reservoir compartment 10 and additional back-up gas under pressure from the cylinder 3 becomes released via side holes 15 and passageways 16 and recess 1' through the needle 9 until the actuator button is released and the system is restored to the inoperative position of FIG. 1, and with a new supply of gas stored and sealed in the valve stem gas reservoir compartment 10 again. This operation provides substantial uniformity of operation during repetitive uses.

The gas cylinders or cartridges 3 are readily attached by unlocking or unscrewing the upper and lower housing portions 2 and 1 at 2', threading the neck of a cylinder 3 into the lower housing 5a of the upper housing portion 2 tightly by hand, causing the piercing tube 8 to penetrate the gas cylinder the desired amount or depth, and rethreading or locking the upper and lower housing portion at 2'.

As shown in FIG. 5, a lateral relief valve 4' comprising a ball 14 and spring 15 urged normally to close off communication with the opening 4 is also provided to prevent excessive pressure on the bottle-to-be-opened. If the pressure inside the housing 1, and hence inside the bottle, exceeds a predetermined safe limit, the valve opens and exhausts the gas to the atmosphere. This reduces the pressure to a safe level. Such pressure relief valves are well known in the art.

In the embodiment of FIGS. 5 and 6, added safety is provided by means of a permanent larger diameter needle protective cover 9''' that receives the bottle top, FIG. 6, (preferably transparent as of "Lexan" plastic or the like to permit operational viewing), instead of the removable sheath cover 9'' of FIG. 1. In operation, FIG. 6 (with gas flow represented by the shading), the bottle top is received within the cover 9''' through its base 23, forcing the stripper plate 22 against the spring 19 slidingly upwardly within the cover as the needle tube 9 penetrates the cork 11. As before, gas is shown forced around the valve stem 5'' and laterally outwardly and then downwardly in the space 16 about the gas cylinder 3, out the opening 4 and through the needle tube 9, exiting through the needle side apertures 9' to pressurize the volume between the cork 11 and the wine level L and force the cork out.

As will be apparent from FIGS. 5 and 6, the cover 9''' is cylindrical and closed at one end that captures a needle holder or body portion 13. The portion 13 supports the needle 9 and connects both the needle 9 and the cover 9''' to the lower housing 1. The stripper plate 22 is generally disk-shaped with two tabs, or ears, 23' extending through axially extending slots 9a formed in the circumferences of the cover 9'''. The base 24 closes the slots 9a and provides a guiding collar for the apparatus when it is placed on a bottle or like container. The stripper plate 9 thereby is captured in the cover 9'''. The spring 19 biases the stripper plate to the position shown in FIG. 5 so the disk lies below the piercing end 9' of the needle 9.

The stripper plate 22 also has a small central aperture 22' that passes over the needle 9 as the apparatus is placed over a cork and forced downward as shown in FIGS. 5 and 6 so the needle 9 penetrates the cork until the piercing end 9' lies below the cork. When the actuator 7 is moved, gas is directed into the bottle and pushes the cork out of the bottle forcing the apparatus with it. The cork then is captured on the hollow needle 9. By grabbing the extensions 22' on the stripper plate 22 and pushing them toward the open end of the cover 9', downwardly in FIGS. 5 and 6, the stripper plate 22 pushes the cork off the needle and returns to the position in FIG. 5 thereby fully enclosing the needle 9.

Figure 7:
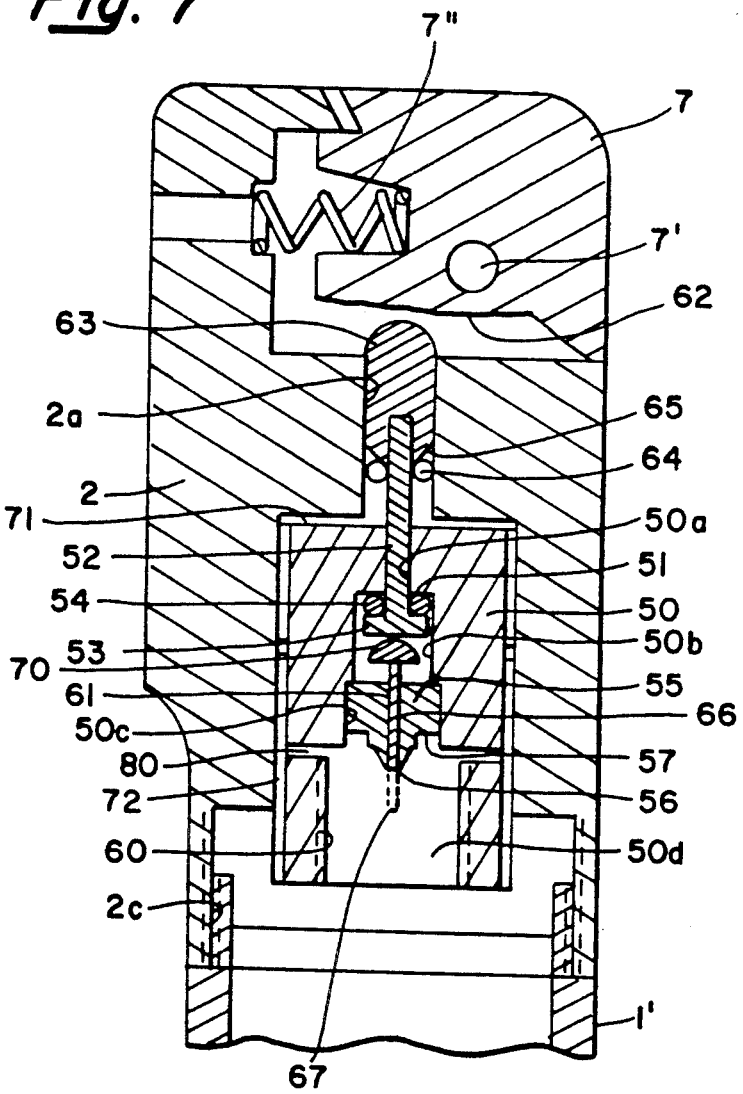
FIG. 7 depicts another embodiment of the valve assembly shown in FIGS. 1 through 6.

FIG. 7 depicts an alternate valve assembly that eliminates the valve spring 5' in FIG. 1 thereby improving the overall reliability of the system. As in the other arrangements shown in FIGS. 1 through 6, the valve assembly is located in the upper housing portion 2. A cylindrical valve body 50 fits in the housing portion 2. The valve body 50 has axially displaced chambers formed therein of differing diameters. A first passage 50a extends between the top of the valve body 50 and a shoulder 51 at the top of a chamber 50b. Its diameter is selected to allow a valve stem 52 to slide freely in the valve body 50.

A piston 53 connects to the lower end of the valve stem 52 and is located in the chamber 50b. The relative diameters of the piston 53 and the chamber 50b allow gas to pass the piston 53 and escape through the chamber 50a. An O-ring 54 mounted on the piston 53 seats on the shoulder 51 to seal the chamber 50b when the piston 53 is in its closed, or upper, position.

Gas from the cylinder enters the chamber 50b through a piercing and stop unit 55. This unit 55 fits in a third chamber 50c contiguous the chamber 50b. The unit 55 includes a piercing section 56 and a stop shoulder 57. These face a threaded portion 60 in a chamber 50d. The unit 55 also contains an axial passage 61 from the piercing section 56 to the chamber 50b to serve as an input port to the chamber 50b. When a gas cylinder is screwed into the threaded portion 60 until it is sealed against the shoulder 57, the piercing section 56 breaks the seal on the end of the cylinder. Gas passes through the passage 61 into the chamber 50b. As the pressure increases, it forces the piston 53 and valve stem 52 upward, and the O-ring 54 seals against the shoulder 51 thereby sealing the chamber 50b. In this embodiment, the gas pressure acting on the piston 53 constitutes the sole sealing force.

In normal operation, the top actuator 7 is pushed from the side and rotates about the pivot 7' against the action of the spring 7''. A cam surface 62 on the actuator 7 rotates toward and engages a cam follower 63 mounted on the end of the valve stem 52. An O-ring 64 mounted to a chamfered surface 65 on the bottom of the cam follower 63 provides a sliding seal between the valve stem 52 and the valve body 50 so gas under pressure does not escape along a passage 2a to the atmosphere.

Normally the piercing section 56 penetrates the seal on the end of the cylinder so the seal hinges and is pushed sideways beside the piercing section 56. At times, however, the seal can completely disconnect from the cylinder and due to high pressure thereafter block the gas passage to prevent gas from passing through piercing and stop unit 15.

Still referring to FIG. 7, a push rod 66 with a stem 67 and a rounded head 70 is located with the stem 67 in the passage 61 and the head 70 in the chamber 50b to prevent such an occurrence. The push rod 66 normally is free to reciprocate in the passage 61 between an upper position as shown and a lower position in which the stem 67 extends below the unit 55 as shown by the dotted lines in FIG. 7. If the cylinder seal disconnects and blocks the passage 61, then during operation the actuator 7 and piston 53 forces the push rod 66 toward the cylinder. The stem moves to its dotted position in FIG. 7. In so doing, the stem 67 probes the cylinder thus clearing the seal from its blocking position to allow proper operation of the cork removal apparatus. It should be noted that normally no forces act on the push rod 66, so the push rod 66 does not effect the position of the piston 53.

When the valve opens under the influence of the actuator 7, gas travels around the stem 67 and through the passage 61 in the same manner as gas flows around the valve stem 5'' in FIGS. 1 through 6. Then the gas flows past by the O-ring 54 and the valve stem 52 into a chamber 71 formed between the top of the valve body 50 and the housing portion 2. The gas passes down two longitudinal passages 72 formed in the outer surface of the valve body 50. The gas then passes through the needle as described with respect to FIGS. 1 through 6.

Figure 8:
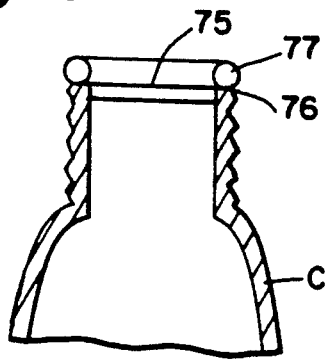
FIG. 8 depicts a modification to a gas cylinder that is particularly adapted for the structure in FIG. 7.

In prior devices, the gas cylinder is sealed to the unit at the piercing and stop unit 55 by means of a gasket or O-ring affixed to the unit 55 or the housing 2. Essentially, the sealing member is part of the apparatus and is used over and over again. It has been found that with repeated use, particularly if gas should escape from the cylinder past that sealing member, the sealing material degrades and eventually fails. It is very difficult for a customer to replace that seal. In accordance with another aspect of this invention, this problem is overcome by modifying a conventional gas cylinder C as shown in FIG. 8. Specifically, the cross section of gas cylinder C at the exit port 74 or neck immediately adjacent its seal 75 is sufficiently thick to allow an O-ring to be affixed to an O-ring seat 76 on the cylinder C. Thus, each new cylinder C provides a new seal with the section 56 on the unit 55. This improves the long-term reliability of the apparatus.

It is possible to remove the cylinder from the unit even though the cylinder is still pressurized. In accordance with the structure shown in FIG. 7 the valve body contains passages 80 that are drilled from the passages 72 into the chamber 50d just below the piercing and stop unit 55. If someone were erroneously to begin removing a pressurized cylinder C, the seal between the O-ring 77 in FIG. 8 and the shoulder 57 in FIG. 7 would break immediately. The gas then exhausts through the passages 80, the passages 72 and the bottom of the housing 2 to the atmosphere. It should be remembered that the lower housing 1' would have been removed prior to attempting the removal of the cylinder C. This seal would open while most of the threads 74 on the cylinder C and the threaded portion 60 were engaged. Thus, the gas should escape well before the cylinder C can be removed from the valve body 5 minimizing the possibility of ejecting the cylinder from the apparatus under force produced by the escaping gases.

Further modifications will also occur to those skilled in this art, and such are considered to fall within the spirit and scope of the invention as defined in the appended claims.

I claim:

1. In an apparatus for removing a stopper from a container, said apparatus being of the type including a gas cylinder for the storage of gas under pressure, hollow needle means for piercing the stopper and injecting gas into the container thereby to pressurize the container and eject the stopper, and gas passage means for establishing a gas flow path from the gas cylinder to said hollow needle means, the improvement of pressure actuated valve assembly means comprising:

A. valve body means interposed in the gas passage means, said valve body means including:
   i. valve seat means formed in one portion of said valve body means for defining a valve body sealing surface, and
   ii. valve body passage means for conveying gas from said valve seat means to said hollow needle means, B. piston-driven valve means for controlling the flow of gas under pressure from the gas cylinder to the hollow needle means, said piston-driven valve means having:
   i. actuator stem means extending through said valve body passage means to terminate at a free end, said actuator stem means guiding said valved means between sealing and open positions, and
   ii. piston means connected to the other end of said actuator stem means, said piston means being located upstream of and overlying substantially all of said valve seat means, c. sealing means carried on said actuator stem means for being interposed between said piston means and said valve seat means for effecting a seal with said valve seat means, and D. actuator means for engaging said free end of said actuator stem means to move said valve means to an open position whereby the gas passes through said gas passage means to the hollow needle means, said valve means being moved to the sealing position when said actuator means is released, gas pressure acting on said piston means providing the dominant force for displacing said piston toward said valve seat means and producing a seal by forcing said piston means and said sealing means against said valve seat means.

2. A stopper removing apparatus as recited in claim 1, wherein said gas cylinder includes a seal for maintaining the gas under pressure in storage and said valve body means additionally comprises:

(1) gas cylinder piercing means spaced from said valve seat means for piercing the gas cylinder seal, and (2) input port means for conducting gas, under pressure, from the gas cylinder and said gas cylinder piercing means to a gas reservoir defined by said valve body means, said valve seat means and said gas cylinder piercing means.

3. A stopper removing apparatus as recited in claim 2, wherein said actuator stem means extends through valve body means to engage said actuator means and includes:

(1) an extension on the end of said actuator stem means proximate said actuator means that is slidable in said valve body means and (2) sealing means operative with said extension to effect a seal between gas reservoir and the atmosphere prevent the escape of gas to the atmosphere.

4. A stopper removing apparatus as recited in claim 2 additionally comprising biasing means acting on said piston means for maintaining said piston in sealing position when the gas reservoir is at atmospheric pressure.

5. A stopper removing apparatus as recited in claim 2 wherein said biasing means comprises spring means in said gas reservoir means.

6. A stopper removing apparatus as recited in claim 2 wherein the gas cylinder has a thin seal at the exit thereof, said stopper removing apparatus additionally comprising push rod means in said gas cylinder piercing means and contacted by said piston means for clearing the gas path to said gas cylinder piercing means in response to movement of said actuator means and said piston means.

7. A stopper removing apparatus as recited in claim 2 wherein said actuator means includes:

(1) a pivot in said housing external to and displaced from said valve body means, and (2) actuating button means mounted on said pivot means, including a surface for engaging said actuator stem means and, (3) bias means to force said actuating button means to a first position whereby said actuating button can be pivoted to a second position that causes said surface to engage said extension and displaces said valve means thereby allowing gas to transfer to the needle means.

8. A stopper removing apparatus as recited in claim 1, additionally comprising pressure relief means in the housing including a relief passage from said gas passage means adjacent needle means to the atmosphere and a pressure relief valve means in said relief passage.

9. An apparatus for removing a stopper from a container of the type that uses gas under pressure to eject the stopper, said removal apparatus including:

A. a first housing,

B. valve body means in said first housing including a first end with an aperture therethrough and a second open end, said first end defining a valve seat at the inner surface thereof adjacent said aperture, said second end securing a gas cylinder to said valve body means, C. input port means mounted in said valve body means and spaced from said first and second ends of said valve body means for piercing a gas cylinder and conducting gas from the cylinder through an aperture in said input port means to a gas reservoir defined by said valve body means between said input port means and said first end, D. piston-driven valve means for controlling the flow of gas under pressure from the gas cylinder through the aperture in said first end of said valve body means, said piston-driven valve means having piston means disposed in said gas reservoir and actuator stem means extending from said piston means through the aperture in said first end of said valve body means thereby to guide said valve means between an open position and a sealing position, E. sealing means carried on said actuator stem means in said gas reservoir between said piston means and said valve seat means, F. means for providing a sliding seal between said actuator stem means and said valve body means, the input of said gas passage means being located between said piston means and said sliding seal means, G. actuator means for applying an opening force to said actuator stem means outside said gas reservoir for moving said valve means to an open position whereby gas passes from said reservoir through said valve body means, said valve means moving to the sealing position when the opening force from said actuator means terminates, gas pressure in said gas reservoir acting on said piston means for producing the sole force that displaces said valve means to the sealing position and produces a seal by forcing said piston means and said sealing means against said valve seat means, H. gas cylinder means including:

i. a hollow cylinder for storing the gas under pressure with means for engaging said securing means, ii. an exit port for said gas including a seal formed there across prior to use of said cylinder, iii. a sealing member mounted to said cylinder means adjacent said exit port, said sealing member preventing the escape of gas from said cylinder means when said piercing means breaks exit said port seal, I. a second housing being detachably mounted to said first housing and including:

i. a first portion surrounding the gas cylinder and communicating with said gas passages, ii. a transverse wall with a gas exit port therethrough, iii. pressure relief means for exhausting the volume around said cylinder, iv. hollow needle means connected at a first end to the exit port for passing through a stopper and conducting gas under pressure into the container through a second end of said needle means thereby to force the stopper out of the container, v. open-ended cylindrical cover means connected to said first end of said needle means and extending coaxially with said needle means, said cover means inclduing longitudinal slots formed therein, vi. disk means having a central aperture for receiving said needle means and inclduing means for engaging the slots in said cover, vii. capture means mounted to said cover means at the open end thereof to capture said disk means, the longitudinal dimension of said cover means and said capture means exceeding the length of said needle means, vii. spring means mounted in said cover and bringing said disk means toward said capture means, said capture means being positioned as said disk means normally covers the second end of said needle means.

* * * * *